United States Patent [19]

Bartzick et al.

[11] 4,219,914

[45] Sep. 2, 1980

[54] ARRANGEMENT FOR OPENING AND CUTTING UP PACKAGING STRAPS FOR SCRAP

[75] Inventors: Günter Bartzick, Gevelsberg; Gerd Bühne, Schwelm, both of Fed. Rep. of Germany

[73] Assignee: Hoesch Werke Aktiengesellschaft, Dormund, Fed. Rep. of Germany

[21] Appl. No.: 969,064

[22] Filed: Dec. 13, 1978

[30] Foreign Application Priority Data

Jan. 27, 1978 [DE] Fed. Rep. of Germany ..... 2803572

[51] Int. Cl.[3] ..... B23D 15/04

[52] U.S. Cl. ..... 29/56.5; 83/909; 83/923; 83/924

[58] Field of Search ..... 29/56.5, 564.3; 83/909, 83/923, 924

[56] References Cited

U.S. PATENT DOCUMENTS 3,377,687 4/1968 Dechellis ..... 83/404 X

*Primary Examiner*—J. M. Meister

*Attorney, Agent, or Firm*—Max Fogiel

[57] ABSTRACT

An arrangement for opening and cutting up packaging straps for scrap, in which a traveling frame moves transversely to a transport track. A cross beam with adjustable elevation has fastened to it a device for snipping and cutting up straps for scrap. A sensor determines the position of the package, of the packaging strap, of shears and shear blades. A control unit with preset control program switches the drives of the transport track, of the traveling frame, of the cross beam and of the device for snipping and cutting up for scrap, which is connected to the sensor. The shears have an extension forward of the lower shear blade with a blade-shaped pointed wedge, and drives for producing a nearly continuous force and for producing impacts attached to the shears. The wedge-shaped extension may form an acute angle with the package surface; this angle is adjustable relative to the package surface via a fulcrum. The force is introduced above the fulcrum parallel to the package surface into a guide carriage holding the shears.

9 Claims, 5 Drawing Figures

ARRANGEMENT FOR OPENING AND CUTTING UP PACKAGING STRAPS FOR SCRAP

BACKGROUND OF THE INVENTION

The present invention relates to an arrangement for automatically opening packages arriving on a transport track where the packaging strap is cut up and fed to a scrap box.

It is known how to open packages by means of a manually operated shears, with the cutting motion being produced electrically or by compressed air. In either case, the shears are placed by an operator at a suitable location on the package. A suitable location is present when the lower blade can be easily slid underneath the packaging strap. With packages having plane surfaces, this is usually the center of a surface. Considerable difficulties are encountered in the sliding of the lower blade of the shears on round packages with a tightly fastened packaging strap. There the packaging strap is in close contact with almost the entire circumference of the package. A small gap is found in most cases only in the vicinity of the closure seal of the packaging strap because the seal is slightly thicker than the packaging strap causing the latter to make a looser contact. This point was previously sought out by the operator to slide the tip of the lower blade under the strap. This closure seal with the arriving packages is located completely irregularly at various points. Therefore, the process of snipping packaging straps on round packages which are strapped particularly tight, could not heretofore, be automated. With round packages, the so-called coils as used in sheet metal processing, there has recently been encountered the difficulty that the coils, weighing several thousand kilograms, are strapped so tightly that the tip of the lower blade of the shears, even if there is a small initial gap, must be driven under the packaging strap with great force produced, for example, by hammer blows. Hence opening the packaging strap on large coils by a human operator is very laborious and expensive.

Accordingly, it is an object of the present invention to provide a fully automatic arrangement for opening even extremely tight packaging straps around round-shaped packages, where the packaging strap is cut up after opening and fed to a storage container.

Another object of the present invention is to provide an arrangement of the foregoing character which is substantially simple in construction and may be economically fabricated.

A further object of the present invention is to provide an installation, as described, which may be readily maintained in service and which has a substantially long operating life.

SUMMARY OF THE INVENTION

The objects of the present invention are achieved by providing an arrangement which has a transport track, a framework spanning the latter, a traveling frame moving transversely to the transport track and a cross beam of adjustable elevation. A device for snipping and cutting up straps is fastened to the cross beam. The arrangement has a scanner or sensor for determining the position of the package of the packaging strap, of the shears and of the blades. A control unit has a preset control program for the drives of the transport track, of the traveling frame, of the cross beam and of the device for snipping and cutting up straps.

So that the arrangement for snipping and cutting up strapping securely grasps the packaging strap, it has shears with an extension in front of the bottom blade. The extension has the shape of a pointed wedge. A drive which produces a nearly continuous force and a drive which produces impacts are attached to the shears. The bottom shear blade is always slid underneath the packaging strap because the wedge-shaped extension makes an acute angle with the surface of the package. That angle is adjustable in relation to the package surface via a fulcrum, and the force of a drive is introduced above the fulcrum approximately parallel to the package surface into a guide carriage which holds the shears.

With curved surfaces of the packages, the difficulty is that the forward edge of the wedge-shaped extension does not make contact throughout the entire width with the surface of the package. A nearly smooth contact throughout the entire width is achieved by rotatably mounting the wedge-shaped extension parallel to its lengthwise axis in a hinged joint. The snipped packaging strap is pulled off the package by providing the arrangement with a transport device delivering the packaging strap section by section to the shears of the snipping device. This transport device is constructed particularly simple and reliable, if it has a feed drive with two facing rollers and also a device for lifting the end of the packaging strap from the package surface, and if a roller of this feed drive can be placed underneath the packaging strap when it is lifted off. An alternating advance of the packaging strap to the shears with intermediate feed stoppages is achieved by having one roller of the feed drive driven and coupled with the stroking shear cutting blade in such a way that, in the open position of the cutting blade, the roller is pressed against the packaging strap and is slightly lifted when the cutting blade leaves the open position; a lever arrangement with stop is installed as a coupling between the cutting blade and the roller. The shears can be made so large that they also cut perfectly when accidentally striking the overlapping ends of the closure (the seal). There is the possibility of keeping the shears and its drive small by always snipping the packaging strap outside the closure seal. This is achieved by providing a proximity switch whose contact is closed when the upper cutting blade is lowered, and by equipping the arrangement with a control unit which is connected with the contact of the proximity switch and the cutting blade drive. When the cutting blade drive is switched on and in the absence of proximity switch closure, the cylinder for the advance of the bottom shear blade, the cylinder for the elevation adjustment, and the device and drive for the traveling frame are switched for travel to their fixed initial positions. After reaching these initial positions, the drive for the transport track is turned on for a short period till the package under the arrangement has advanced by a distance which is at least equal to the length of the closure seal of the packaging strap.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
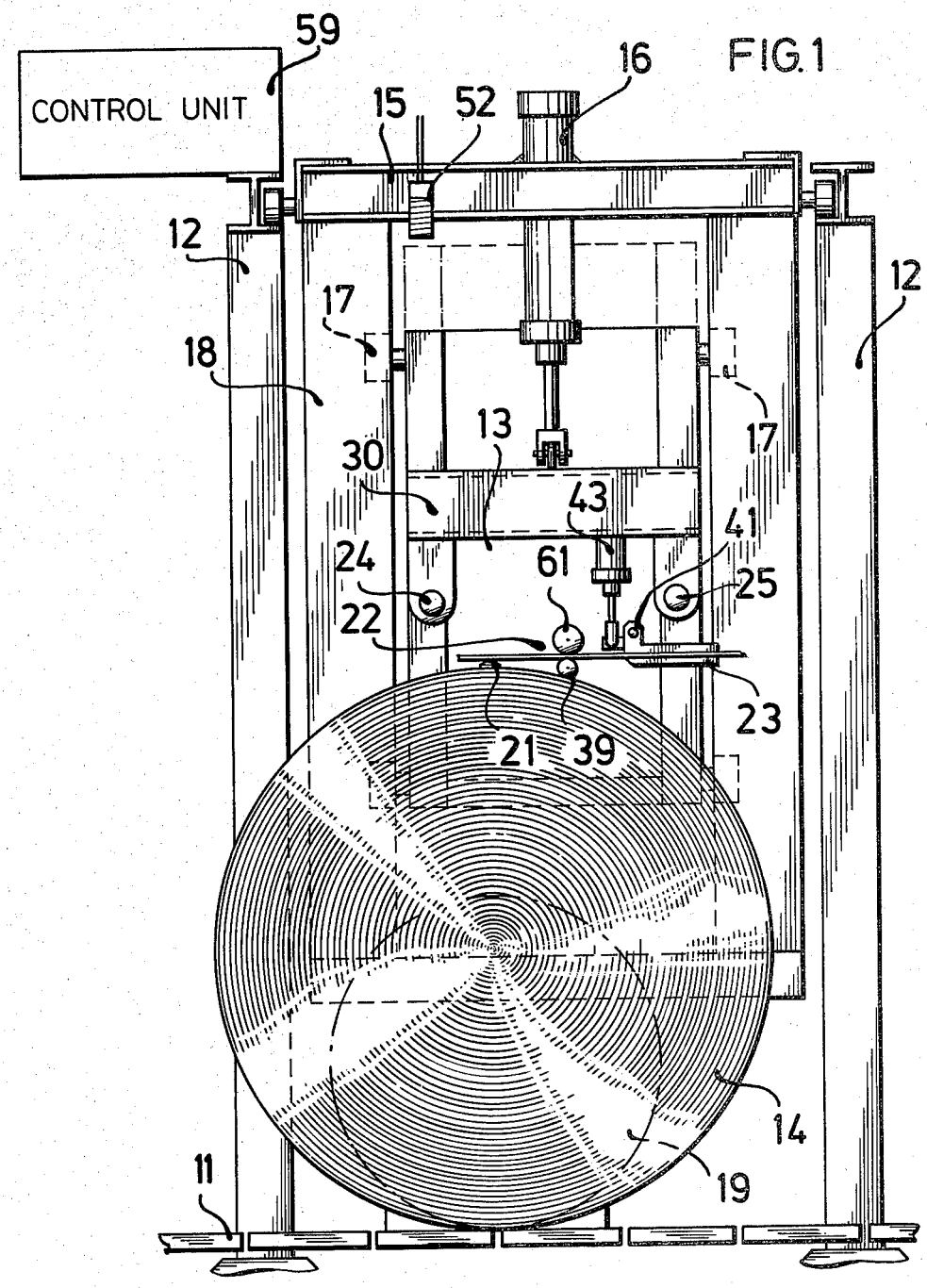
FIG. 1 shows an elevational overall view of the ar-ngement according to the present invention.

The arrangement for opening and cutting up packag-g strap 31 has a framework 12 and a traveling frame 15 hich span a transport track 11 via which the packaged m 14 is transported underneath the arrangement. The vice 13 for snipping and cutting up the packaging ap 31 is fastened with its elevation adjustable under-ath the traveling frame 15. The traveling frame 15 rmits displacement of the arrangement 13 across the nsport track 11 and the cylinder 16, provided for evation adjustment in relation to transport track 11. he device 13 travels vertically by means of wheels 17 d the associated tracks 18. The smallest package to be ocessed is denoted by 19. In FIG. 1, package 14 lies derneath device 13 in the processing position. The ears 21 for snipping the packaging strap 31 is only dicated in FIG. 1 by its tip. At the righthand side of is tip are the transport device 22 and the guiding vice 23 for the packaging strap 31.

The cross beam 30 serves as base for the moving and ive units of shears 21, of the transport device 22, and the guiding device 23. The cross beam 30 is lowered means of cylinder 16 till the bottom blade 28 of ears 21 makes direct contact with the package 14 and ces the packaging strap 31 to be snipped.

The guides 24 and 25 permit a horizontal travel of the ide carriage 26 via the cylinder 27. The guide car-age 26 can also be rotated slightly about fulcrum 29 so at, during actuation of cylinder 27, the guide carriage is moved by the guides 24 and 25 in the direction ansversely to the packaging strap 31; at the same time, e tip of shears 21 is pressed downward against the ckage 14 because of the fulcrum 29.

Figure 3:
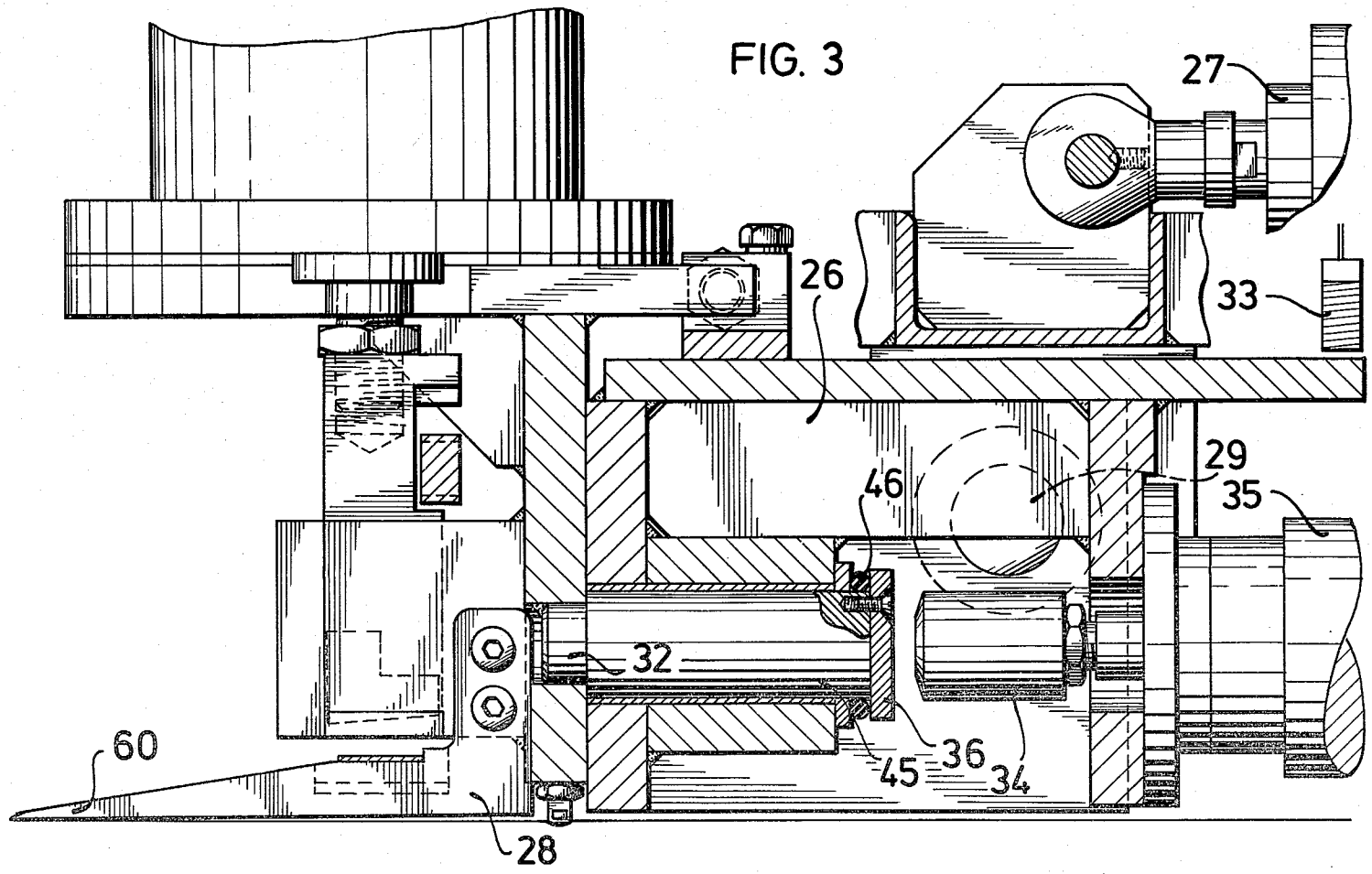
FIG. 3 is a partial sectional view and shows the ears, with guide carriage.

Thus, the entire carriage 26 is slightly rotatable about is 29, shown in FIG. 3. As a result of the rotation, the wer blade or knife 28 is turned out of the horizontal osition and inclined somewhat downward. This incli-ation may be seen in FIG. 3. The downward rotation ay occur due to the own weight of the carriage 26. rom the inclined position of the lower knife 28, the tter is rotated again upward, so that the point 60 of the wer knife 28 is seated on the coil or package 14, and e cross beam 30 is further lowered, through cylinder 5, over a small distance after the point 60 is seated, till e damped proximity switch 33 is actuated and the escending movement stops. The downward inclined osition of the lower knife 28 corresponds to its initial osition.

Figure 2:
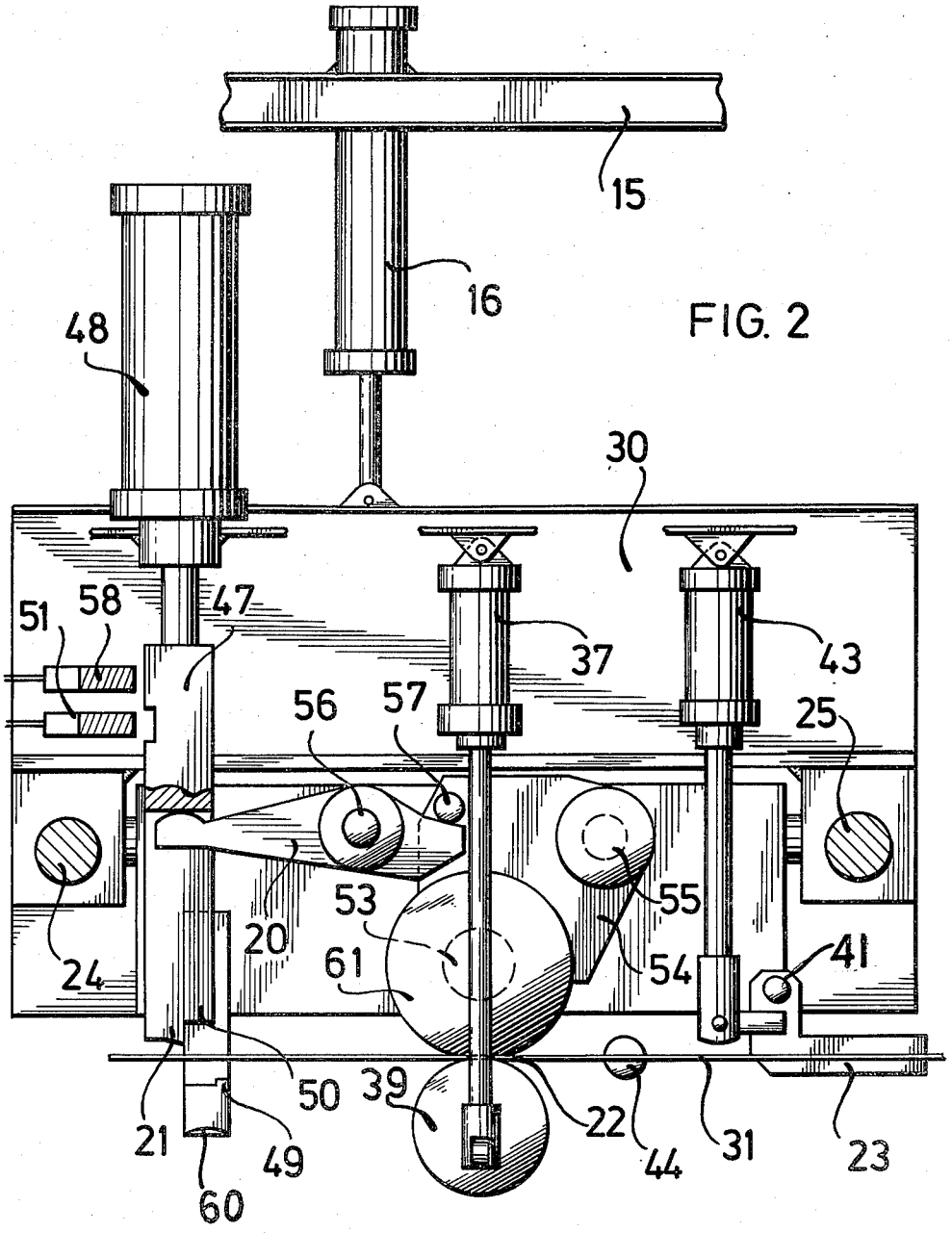
FIG. 2 is a partial sectional view of the transport vice for the packaging strap.

FIG. 2 shows the transport device 22 which feeds the ackaging strap 31 to the shears for cutting up. The ansport device 22 consists of two rollers between hich the packaging strap 31 is located. The upper oller 61 is driven by a motor (not shown). To provide at the packaging strap 31 stands still during the cutting action of shears 21, the shears 21 is connected via lever 20 to the transport device 22 in such a way that the upper roller 61 of the transport device 22 is lifted off the packaging strap 31 when the upper blade of shears 21 moves downward during the cut. A guiding device 23 ensures that the packaging strap 31 is fed in a centered manner into transport device 22.

Upon unwinding the strap, the clamping edge 50 (FIG. 2) clamps the unwound strap end to the upper blade. The device 13 lifts off the coil through cylinder 16, and takes along the clamped end of the strap. In the upper position, the transport roller 39 (FIG. 2) rotates below the strap that has been taken along, and transports the strap through the chopper (severing knife 60, 21, FIG. 2).

When placing the shears 21 on the surface of package 14, it is important that the leading edge of the lower blade always touches the surface of the package 14. Good contact of the leading edge of the bottom blade is obtained by mounting the shears 21 on a joint. A joint whose axis is parallel to the lengthwise direction of the lower edge is denoted by 32. This joint 32 prevents tilting (misalignment) of the leading blade edge. The joint, which forms a 90° angle with the first joint 32, with the fulcrum 29, ensures that the leading edge of the blade always contacts the surface of package 14, and that with an incorrect position of package 14 it never occurs that the rear portion of the blade contacts the package 14 and that the front part does not.

FIG. 3 shows an automatic hammer (rammer) which is driven by cylinder 35 and which strikes the anvil 36, thus driving the lower blade of shears 21 underneath the packaging strap 31.

Figure 4:
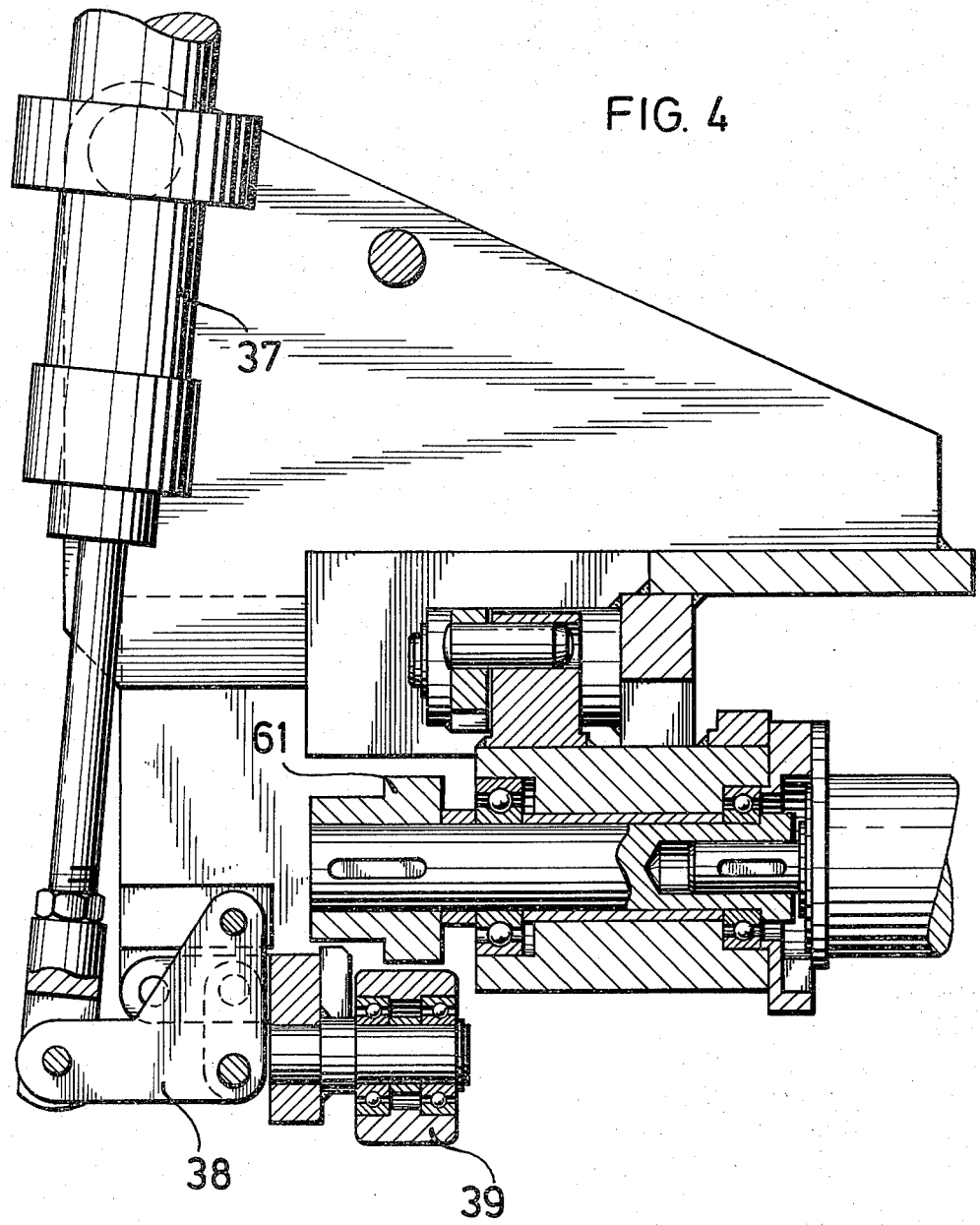
FIG. 4 shows the tilting device on one of the feeder llers.
Figure 5:
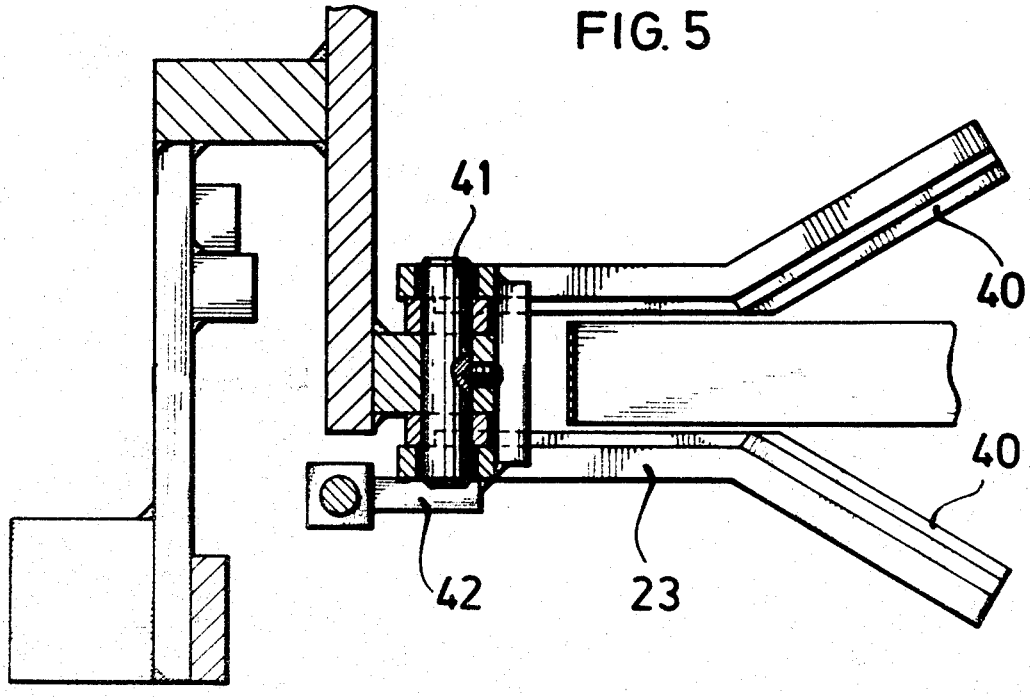
FIG. 5 shows a guide mechanism for the packaging ap.

FIG. 4 shows the tilting mechanism of lower roller 39 of transport device 22. This mechanism comprises the cylinder 37, the lever drive 38 and the lower roller 39. In order that, during the snipping of the packaging strap 31, one end does not drop off to the side, the guiding device 23, shown in FIG. 5, is pressed against the surface of the package 14. The guiding device 23 has a funnel-shaped chute with the edges 40. The funnel-shaped chute can be rotated about the axis 41 and is pivoted about this axis 41 by the cylinder 43 acting on lever 42. The snipping and cutting up of the packaging strap 31 is carried out as follows:

The package 14 is delivered along the transport track 11 to the device 13. The transport track 11 is stopped when the package 14 is underneath the device. The stopping is achieved by known means, for example, photocells (not shown). They simultaneously open the air supply to cylinder 16. As a result, the cross beam 30 is lowered from its top waiting position. The waiting position, where the traveling frame 15 was previously, is constructed so that the shears 21, even with off-center fluctuations of the packaging strap 31, is always in front of the strap even while the shears are still above the package 14. The lowered shears 21 strikes the surface of the package 14 with the tip of the lower blade in a region which is about 40 mm from the edge. When the wedge-shaped extension 60 of the lower blade, which makes an acute angle with the package, touches the package 14 during the descending movement of the cross beam 30, the guide carriage 26 is moved about the fulcrum 29 till the damped proximity switch 33 is released and the descending movement stops. At the same time, cylinder 27 of the guide carriage 26 is actuated; the wedge-shaped extension 60 of the lower blade is slid underneath the packaging strap 31 until the packaging strap 31 is in the region of the lower blade which is indicated by the proximity switch 44. This process is monitored by a timing circuit located in the control unit 59 so that, after a predetermined period, a striker unit, comprising the bolt 45, the rubber ring 46, the anvil 36 and the hammer (rammer) 34 and the cylinder 35, is actuated if the proximity switch 44 was not previously tripped because of inadequate feed of cylinder 27 —if the strapping is extremely tight. After tripping the proximity switch 44, the guiding device 23 is pivoted by means of cylinder 43 and contacts the surface of package 14 so that the packaging strap 31 is guided during the snipping process. The cylinder 43 remains under air pressure. At the same time, the under blade 47 of shears 21 is actuated via cylinder 48. At the start of the stroke, this cylinder clamps the packaging strap 31 between the clamping member 49 and the clamping edge 50, and then splits it with the same motion and keeps the right-end of packaging strap 31 clamped. By lowering the upper blade 47, proximity switch 51 is tripped and delivers a switching pulse to cylinder 16, causing the cross beam 30 with the entire device 13 and the clamped right-hand end of the packaging strap 31 to be raised. The fork of the guiding device 23 assumes a vertical position. By tripping the proximity switch 52, the lower roller 39, which together with the driven upper roller 61 constitutes the transport device 22, is swung in. The upper roller 61 is connected via shaft 53 with a drive motor (not shown) and is mounted in the transport wheel rocking arm 54 which rotates about fulcrum 55. Since the drive motor runs continuously, it is necessary that the upper roller 61 be raised during the cutting operation. This is accomplished by lever 20 which is mounted on bolt 56 and whose left-hand lever arm projects into a recess in the upper blade 47, while the right-hand lever arm raises the transport wheel rocking arm 54 via the carrier bolt 57 when blade 47 moves downward. With the swing-in motion of lower roller 39, the drive motor for the upper roller 61 is turned on after the first cut (snip) of the packaging strap 31 and the upper blade is moved upward via the cylinder 48. This releases the clamped strap end so that the transport device 22 transports the packaging strap 31 by a small amount till the blade 47 is lowered again and starts a cutting motion. If the upper blade 47 is in the top position, proximity switch 58 is tripped; this redirects cylinder 48 so that the upper blade 47 is lowered again.

The proximity switches 51 and 58 alternately control the upper blade 47 so that, in conjunction with the transport device 22, the packaging strap 31 is cut section by section. This process is repeated until the proximity switch 44 is no longer tripped by packaging strap 31. Whether the proximity switch 44 is still tripped by the packaging strap 31 is determined by the control unit 59 which, in case of non-engagement, returns the device 13 and the traveling frame 15 to their initial positions.

The process of strap chopping is preferably undertaken above a scrap box which is located outside the package region so that the chopped up portions of the packaging strap 31 fall by gravity via a chute into the scrap box.

The pulse for moving the traveling frame 15 is provided by proximity switch 52 when the cylinder 16 has moved the entire device 13 into the upper position.

With this action, the arrangement for opening and scrapping (cutting up) package straps has again assumed its initial waiting position and is ready for the next package.

The device 13 can be equipped with an additional proximity switch 51 which also is connected to the control unit 59 having an accessory unit. If the shears by accident strike the closure seal of the packaging strap 31, the proximity switch 51, in conjunction with the accessory unit in control unit 59, interrupts the cutting process of the shears and starts anew at another point on the packaging strap 31.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. An arrangement for opening and cutting up packaging straps for scrap, comprising: a transport track; a framework spanning said transport track; a traveling frame traveling transversely to said transport track; a cross beam with adjustable elevation; means for snipping and cutting up strapping fastened to said cross beam; sensing means for determining positions of a package and of packaging strips on the package; shears and shear blades with positions determined by said sensing means; control means connected to said sensing means and having a preset control program; and drive means for said transport track, said traveling frame, said cross beam and said means for snipping and cutting up; said control program switching said drive means on and off; said shears simultaneously cutting said strapping and chopping up said strapping; an end of said strapping being clamped simultaneously with the cutting of the strapping.

2. An arrangement as defined in claim 1 including shears with a forward extension of a lower one of said shear blades, said extension having the shape of a blade-shaped pointed wedge, and drive means attached to said shears for producing a nearly continuous force and impacts.

3. An arrangement as defined in claim 2 including a guide carriage, said extension forming an acute angle with a surface of said package, said angle being adjustable in relation to said package surface via a fulcrum, said force being introduced above said fulcrum substantially parallel to said package surface into said guide carrier holding said shears.

4. An arrangement as defined in claim 2, including a hinged joint, said extension being rotatably mounted parallel to its lengthwise axis in said hinged joint.

5. An arrangement as defined in claim 1 including transport means for transporting said packaging strap by sections to said shears.

6. An arrangement as defined in claim 5 wherein said transport means has a feed drive with two facing rollers and means for lifting an end of said packaging strap from the package surface, a first one of said rollers of said feed drive being placed underneath said packaging strap when lifted off the package surface.

7. An arrangement as defined in claim 6 wherein a second one of said rollers of said feed drive is driven and coupled with the upper one of said shear blades, said second roller in an open position of said shear blade being pressed against said packaging strap and being lifted from said packaging strap upon leaving said open position of said shear blade.

8. An arrangement as defined in claim 7 further comprising a lever with stop as coupling between said upper shear blade and said second one of said rollers.

9. An arrangement as defined in claim 1 including a proximity switch having a contact closed when said upper shear blade is in a lowered position; control means connected to said contact of said proximity switch and drive means for said upper cutting blade, said control device setting a cylinder for driving said lower one of said shear blades when said drive for said upper cutting blade is turned on and said contact is open; a cylinder for said adjustable elevation and a cylinder for driving said traveling frame to their fixed initial positions, drive means for said transport track being turned on for a substantially short interval until said package has moved forward by a distance at least equal to the length of a closure seal of said packaging strap.

* * * * *